US007004061B2

(12) United States Patent
Kurihara

(10) Patent No.: US 7,004,061 B2
(45) Date of Patent: Feb. 28, 2006

(54) SWASH-PLATE COMPRESSOR HAVING A SPECIAL SLIDING SURFACE BETWEEN A COUPLING PORTION OF A PISTON AND A SHOE

(75) Inventor: Masayuki Kurihara, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 10/743,399

(22) Filed: Dec. 23, 2003

(65) Prior Publication Data

US 2004/0136836 A1 Jul. 15, 2004

(30) Foreign Application Priority Data

Dec. 27, 2002 (JP) ..... 2002-380870

(51) Int. Cl.
*F01B 13/04* (2006.01)

(52) U.S. Cl. ..... 92/12.2; 92/71

(58) Field of Classification Search ..... 92/12.2, 92/71; 417/269

See application file for complete search history.

(56) References Cited

U.S. PATENT DOCUMENTS

| | | | | |
|---|---|---|---|---|
| 5,943,941 | A * | 8/1999 | Kato et al. | 92/71 |
| 6,308,615 | B1 * | 10/2001 | Takenaka et al. | 92/71 |
| 6,582,200 | B1 * | 6/2003 | Kato et al. | 92/71 |
| 6,752,065 | B1 * | 6/2004 | Sugioka et al. | 92/71 |
| 2001/0003258 | A1 | 6/2001 | Fukai et al. | |

FOREIGN PATENT DOCUMENTS

| | | |
|---|---|---|
| JP | 2001165041 | 6/2001 |
| JP | 2001165046 | 6/2001 |

* cited by examiner

*Primary Examiner*—Thomas E. Lazo
(74) *Attorney, Agent, or Firm*—Baker Botts L.L.P.

(57) ABSTRACT

In a swash-plate compressor having a shoe slidably coupling a coupling portion of a piston to a swash plate, the coupling portion has a spherical contact surface and the shoe has a spherical surface slidable along the contact surface. At least one of the contact surface and the spherical surface has an oxide film retaining a number of self-lubricating particles. The swash plate is attached to a drive shaft which is rotatable. The piston performs reciprocal movement by the rotation of the swash plate.

11 Claims, 3 Drawing Sheets

SWASH-PLATE COMPRESSOR HAVING A SPECIAL SLIDING SURFACE BETWEEN A COUPLING PORTION OF A PISTON AND A SHOE

This application claims priority to prior Japanese patent application JP 2002-380870, the disclosure of which is incorporated herein by reference.

BACKGROUND OF THE INVENTION

This invention relates to a swash-plate compressor for use in an automotive air conditioner or the like.

A swash-plate compressor of the type is disclosed, for example, in Japanese Patent Application Publications (JP-A) Nos. 2001-165041 and 2001-165046. The swash-plate compressor comprises a piston reciprocally moved by rotation of a swash plate fixed to a drive shaft. The swash plate and a coupling portion of the piston are slidably connected through a pair of semi-spherical shoes. Each of the shoes has a spherical surface which slides along a generally spherical contact surface of the coupling portion of the piston to thereby convert the rotation of the swash plate into reciprocal movement of the piston. The slidability and the seizure resistance between the spherical surface of the shoe and the contact surface of the coupling portion are important in order to assure the operability and the durability of the compressor as a whole.

Generally, one of the spherical surface of the shoe and the contact surface of the coupling portion along which the spherical surface of the shoe slides and moves is plated with Sn excellent in self lubrication or applied with a solid lubricant. Thus, a soft surface treatment layer having a lubricity is produced. With this structure, an excellent slidablity and an excellent seizure resistance are expected in an initial state.

However, because the surface treatment layer is soft, the surface treatment layer is easily peeled off or worn. Therefore, during long-time use, the wear resistance and the seizure resistance are not maintained. Furthermore, a lubricating oil between the contact surface of the coupling portion and the spherical surface of the shoe may be washed away by a condensed liquid refrigerant. If the compressor is started in the state where the contact surface and the spherical surface are dried up after the lubricating oil is washed away, the slidability of the shoe is further deteriorated. In addition, a high-load operation owing to liquid compression may bring about instantaneous wear or peeling-off of the surface treatment layer. This results in occurrence of scuffing on the contact surface and a risk of undesirably locking the compressor. In case where a natural refrigerant gas (for example, $CO_2$, $CH_4$) is used, it is supposed that a sliding portion of the compressor is required to have more strict environment adaptation. Therefore, it is desired to further improve the slidability and the seizure resistance.

SUMMARY OF THE INVENTION

It is therefore an object of the present invention to provide a swash-plate compressor capable of sufficiently and stably assuring the slidability, the wear resistance, and the seizure resistance of a sliding portion of the compressor.

Other objects of the present invention will become clear as the description proceeds.

According to an aspect of the present invention, there is provided a swash-plate compressor comprising a drive shaft to be rotated, a piston having a coupling portion and reciprocally movable by rotation of the swash plate, and a shoe slidably coupling the coupling portion to the swash plate, the coupling portion having a spherical contact surface, the shoe having a spherical surface slidable along the contact surface, at least one of the contact surface and the spherical surface having an oxide film retaining a number of self-lubricating particles.

DESCRIPTION OF THE PREFERRED EMBODIMENT

Figure 1:
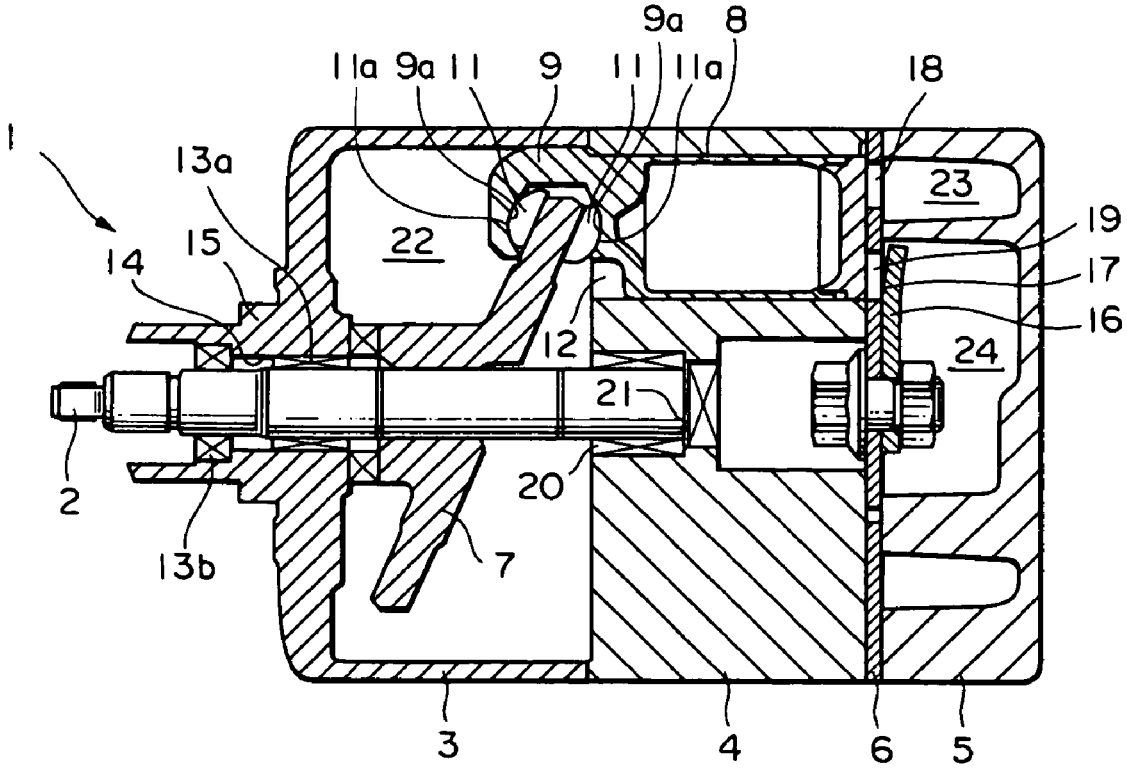
FIG. 1 is a side sectional view of a swash-plate compressor according to one embodiment of the present invention.

Referring to FIG. 1, description will be made of a swash-plate compressor according to one embodiment of the present invention.

The swash-plate compressor depicted at 1 in the figure is of a fixed volume or displacement type equipped in a refrigerating circuit of an automotive air compressor. The swash-plate compressor 1 comprises a front housing 3, a cylinder block 4, a cylinder head 5, and a plurality of bolts (not shown) fastening and fixing these components. Between the cylinder block 4 and the cylinder head 5, a valve plate 6 is interposed.

The swash-plate compressor 1 has a rotatable drive shaft 2 extending along a center axis thereof. The drive shaft 2 is inserted in an inner wall hole 14 formed in a shaft support portion 15 protruding outward from the front housing 3 and is rotatably supported by the shaft support portion 15 through a radial bearing 13*a* and a shaft seal 13*b*. The drive shaft 2 has one end exposed outside through the front housing 3 and connected through an electromagnetic clutch (not shown) to an external power source so that the drive shaft 2 and the external power source are engaged and disengaged. The drive shaft 2 has the other end inserted into an axial hole 21 formed at the center of the cylinder block 4 and supported through a bearing unit having a needle bearing 20.

The cylinder block 4 is provided with a predetermined number of (typically, seven) cylinder bores 12 formed around the center axis. To the cylinder bores 12, a predetermined number of (typically, seven) pistons 8 made of an aluminum material as a raw material are inserted and fitted, respectively, so as to be slidable in an axial direction. Each of the pistons 8 has a coupling portion 9 as a tail portion integrally formed. Following the rotation of the drive shaft 2, each piston 12 reciprocally moves linearly within the cylinder bore 12 in accordance with a mechanism which will presently be described.

The front housing 3 and the cylinder block 4 define a crank chamber 22 in which a swash plate 7 is disposed. The swash plate 7 is attached to the drive shaft 2 and driven by the drive shaft 2 to be rotated. When the swash plate 7 is rotated, the pistons 8 performs reciprocal movement. In order to cause the reciprocal movement of the pistons 8 by the rotation of the swash plate 7, a pair of semispherical shoes 11 are interposed between the swash plate 7 and the coupling portion 9 of each piston 8 to be slidable. Each of the shoes 11 has a spherical convex surface 11*a*. On the other hand, the coupling portion 9 has a pair of contact surfaces 9*a* of a generally spherical concave shape. With sliding movement of the spherical convex surfaces 11*a* of the shoes 11 along the contact surfaces 9*a* of the coupling portion 9, the rotation of the swash plate 7 is converted into the reciprocal movement of the pistons 8 through the shoes 11.

Furthermore, the valve plate 6 is provided with a discharge hole 19 and a suction hole 18 which correspond to each cylinder bore 12. A leaf valve 17 is attached as a discharge valve to the valve plate 6 to face the discharge hole 19. On the leaf valve 17, a retainer 16 is disposed.

The cylinder head 5 has a discharge chamber 24 formed at the center and a suction chamber 23 extending around the discharge chamber 24. The discharge chamber 24 is connected to a high-pressure side of the refrigerating circuit through a discharge port (not shown) and serves to supply a high-pressure gas to a condenser (not shown). The suction chamber 23 is connected to a low-pressure side of the refrigerating circuit through a suction path defined by a gas passage (not shown) and a suction port (not shown) and serves to receive a return gas from an evaporator (not shown).

Figure 2:
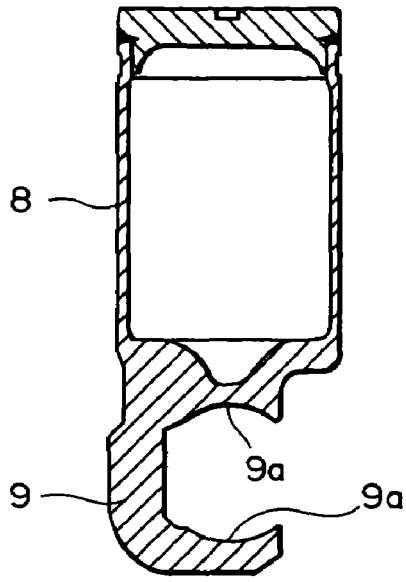
FIG. 2 is a sectional view of a piston of the swash-plate compressor illustrated in FIG. 1.
Figure 3:
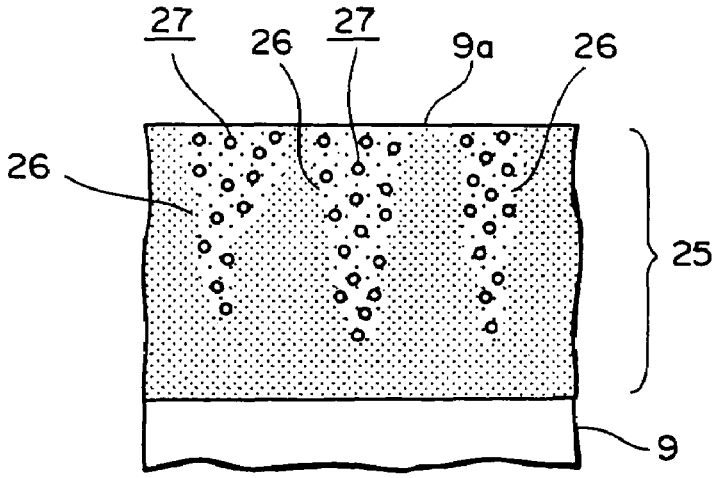
FIG. 3 is an enlarged sectional view of a characteristic part of a coupling portion of a piston illustrated in FIG. 2.

Referring to FIGS. 2 and 3, the structure of the piston 8 will be described in detail.

As illustrated in FIG. 2, the coupling portion 9 of the piston 8 is provided with a pair of the contact surfaces 9*a*. Each of the contact surfaces 9*a* is subjected to anode oxidation as a surface treatment so that an oxidized film or aluminum oxide film 25 (so-called alumite) is formed as a surface treatment layer. As known in the art, the oxide film 25 has a number of microscopic pores 26 regularly arranged therein. Therefore, the oxide film 25 may be called a porous anodic oxide film.

Furthermore, a great number of self-lubricating particles or grains 27 are deposited in each of the microscopic pores 26 by secondary electrolysis from the bottom towards the entrance or opening of the microscopic pores 26. Each of the self-lubricating particles is made of a substance having a function of self-lubricating known in the art. As a result, the oxide film 25 retains a number of the self-lubricating particles. The porous anodic oxide film 25 may be formed on the spherical surface of the shoe but is preferably formed on the contact surface 9*a* of the coupling portion 9 in view of the easiness in production and the mechanical strength during a compressing operation.

Preferably, the porous anodic oxide film 25 has a thickness of 5 $\mu$m or more and a surface hardness of 250 HV or more. As a material for production of the porous anodic oxide film 25 by anode oxidation, use may be made of at least one kind of (one kind of or two or more kinds of) solid lubricant containing $MoS_2$ or PTFE as a main component. Alternatively, a material comprising an organic iodine compound may be used. Use of the solid lubricant containing $MoS_2$ as a main component is advantageous because most excellent characteristics are achieved.

When the oxide film 25 is formed, the anode oxidation causes generation of alumite with a number of microscopic pores 26 regularly arranged therein. Generally, in case where alumite is produced only by the anode oxidation, it is necessary to carry out a sealing process for sealing each microscopic pore 26. However, by the secondary electrolysis mentioned above, the self-lubricating particles 27 are deposited in the microscopic pores 26 to impregnate the oxide film 25. Therefore, the sealing process is not required.

Furthermore, the surface treatment layer thus obtained has both of a high hardness of alumite and an excellent self lubrication of the self-lubricating particles. Therefore, not only the slidability (fittability by lubrication) and the seizure resistance (scuffing resistance) in an initial stage of operation but also the wear resistance and the seizure resistance during long-time use is improved. As a consequence, it is possible to sufficiently and stably assure the slidablity, the wear resistance, and the seizure resistance of a sliding portion of the compressor. Furthermore, the oxide film used as the surface treatment layer is high in adhesion with an aluminum material as a raw material of the piston so that the peeling resistance is improved. In addition, the oxide film is formed by such an electrochemical process so that the film can be formed in various surface profiles and in a uniform condition. In addition, the thickness of the film can easily be controlled. Thus, the production is easy.

As will be described in conjunction with FIG. 4, the above-mentioned swash-plate compressor is advantageous in that, even if the compressor is used for a long time in a severe operating condition by the use of a refrigerant gas adapted to environment protection as a recent demand for environment protection, the slidability, the wear resistance, and the seizure resistance between the spherical surface of the shoe and the contact surface 9*a* of the coupling portion 9 can sufficiently and stably be assured.

Figure 4:
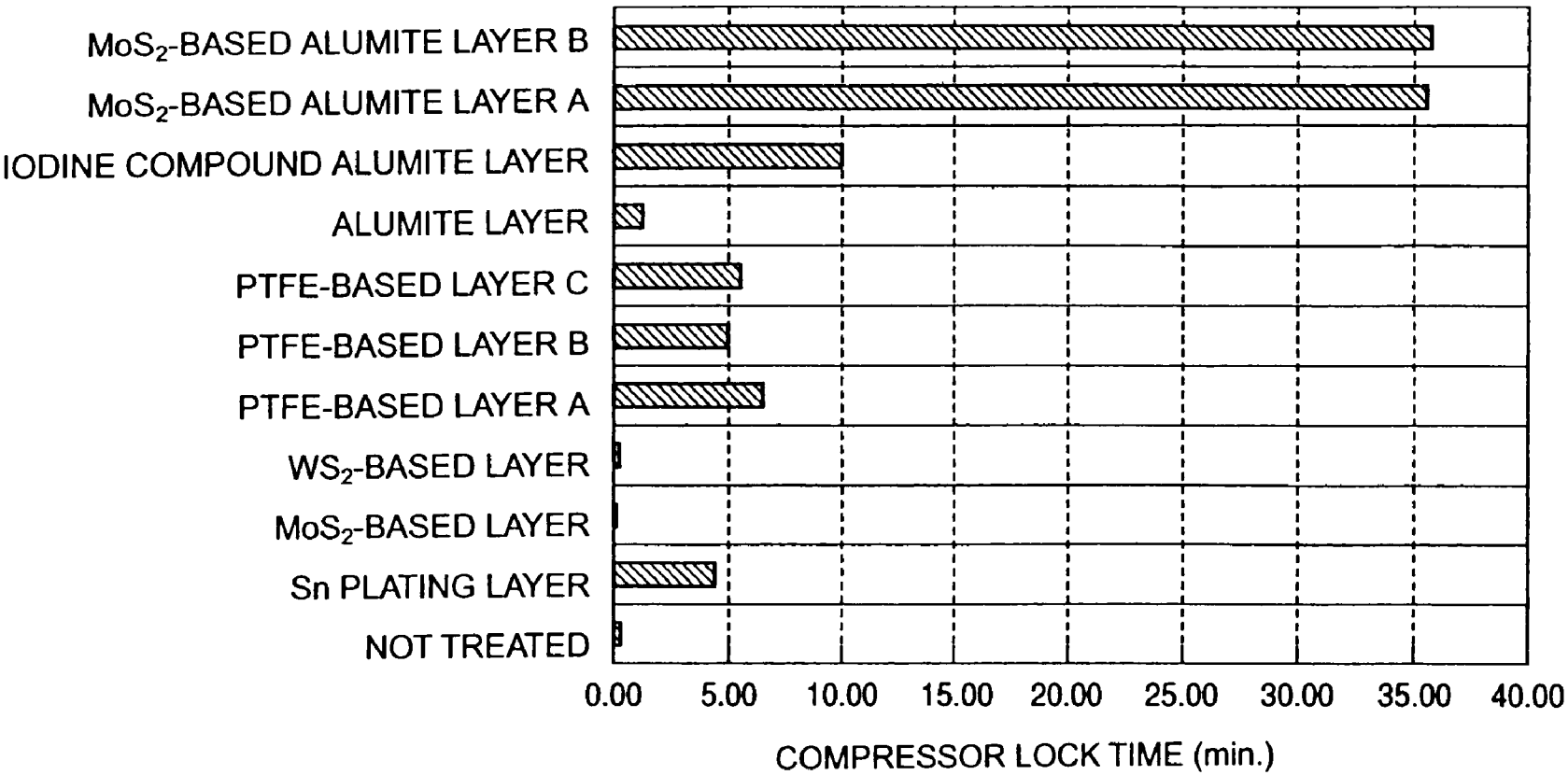
FIG. 4 is a graph for describing the effect of this invention.

FIG. 4 shows the result of measurement of a compressor lock time which is representative of durability of compressors and is a time (minutes) from a start of driving each of the compressors to a locked stop thereof. The measurement was carried out under the same operating condition among the compressors by the use of a refrigerant gas adapted to the environment protection as the recent demand and without using a lubricating oil. As examples of the present invention and comparative examples, the oxide film 25 was formed on the contact surface 9*a* of the coupling portion 9 in the swash-plate compressor by the use of various materials and the compressor lock time was measured. In addition, the measurement was also made in case where the contact surface 9*a* is not treated (i.e., does not have a surface treatment layer).

From FIG. 4, it is understood that, in case where each of $MoS_2$-based alumite layers A and B (slightly different in composition from each other) and an iodine compound alumite layer is used as the surface treatment layer, the compressor lock time is long as compared with the case where each of a typical plating layer, PTFE-based (coating) layers A, B, and C is used as the surface treatment layer or the case where other layer, such as an alumite layer having no self-lubricating particles 27, is used as the surface treatment layer. In particular, in case where each of the $MoS_2$-based alumite layers A and B is used as the surface treatment layer, the compressor lock time is extremely long. Such a long compressor lock time represents a sufficient improvement in durability. It has also been found out that the compressor lock time in case of the alumite layer having no self-lubricating particles is shorter than that in case of the typical plating layer or the PTFE-based (coating) layer A, B, or C. Furthermore, in case of a $WS_2$-based (coating) layer or a $MoS_2$-based (coating) layer, the compressor lock time is shorter than that in case of no treatment.

While the present invention has thus far been described in connection with a few embodiments thereof, it will readily be possible for those skilled in the art to put this invention into practice in various other manners. For example, the above-mentioned surface treatment layer may be formed on at least one of the contact surface formed on the coupling portion of the piston and the spherical surface formed on the shoe. In other words, the surface treatment layer may be formed on both of or only one of the contact surface of the coupling portion and the spherical surface of the shoe.

What is claimed is:

1. A swash-plate compressor comprising:

a drive shaft to be rotated;

a piston having a coupling portion and reciprocally movable by rotation of the swash plate; and a shoe slidably coupling the coupling portion to the swash plate, the coupling portion having a spherical contact surface, the shoe having a spherical surface slidable along the contact surface, at least one of the contact surface and the spherical surface having an oxide film retaining a number of self-lubricating particles therein.

2. The swash-plate compressor according to claim 1, wherein the oxide film is formed on at least one of the shoe and the coupling portion by anode oxidation.

3. The swash-plate compressor according to claim 2, the oxide film further comprising impregnated self-lubricating particles.

4. The swash-plate compressor according to claim 1, the oxide film further comprising a plurality of microscopic pores, and each of the plurality of microscopic pores contain the self-lubricating particles, wherein the self-lubricating pores are deposited in the microscopic pores by electrolysis.

5. The swash-plate compressor according to claim 1, the oxide film further comprising a plurality of regularly spaced, microscopic pores.

6. The swash-plate compressor according to claim 4, wherein the oxide film is formed on at least one of the shoe and the coupling portion by anode oxidation.

7. The swash-plate compressor according to claim 4, wherein the oxide film comprises a solid lubricant, the self-lubricating particles being deposited by electrolysis of the solid lubricant.

8. The swash-plate compressor according to claim 1, wherein the oxide film has a thickness of 5 $\mu$m or more and a surface hardness of 250 HV or more.

9. The swash-plate compressor according to claim 1, wherein the oxide film is made of at least one kind of solid lubricant containing $MoS_2$ as a main component.

10. The swash-plate compressor according to claim 1, wherein the oxide film comprises at least one kind of solid lubricant containing PTFE as a main component.

11. The swash-plate compressor according to claim 1, wherein the oxide film comprises an organic iodine compound.

* * * * *

UNITED STATES PATENT AND TRADEMARK OFFICE

CERTIFICATE OF CORRECTION

PATENT NO. : 7,004,061 B2
DATED : February 28, 2006
INVENTOR(S) : Masayuki Kurihara It is certified that error appears in the above-identified patent and that said Letters Patent is hereby corrected as shown below:

Column 5,
Line 26, delete "pores" (first occurrence) and insert -- particles --.

Signed and Sealed this

Thirtieth Day of May, 2006

JON W. DUDAS
*Director of the United States Patent and Trademark Office*